US008451305B2

(12) United States Patent
Shoji et al.

(10) Patent No.: US 8,451,305 B2
(45) Date of Patent: May 28, 2013

(54) HEAD UNIT, PRINTER, AND METHOD OF MANUFACTURING HEAD UNIT

(75) Inventors: Noriyoshi Shoji, Chiba (JP); Toshimitsu Morooka, Chiba (JP); Keitaro Koroishi, Chiba (JP); Norimitsu Sanbongi, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 13/200,248

(22) Filed: Sep. 21, 2011

(65) Prior Publication Data

US 2012/0069124 A1 Mar. 22, 2012

(30) Foreign Application Priority Data

Sep. 22, 2010 (JP) ..... 2010-212552

(51) Int. Cl.
*B41J 2/335* (2006.01)

(52) U.S. Cl.
USPC ..... 347/200; 347/205

(58) Field of Classification Search
USPC ..... 347/200, 202, 205
See application file for complete search history.

(56) References Cited

U.S. PATENT DOCUMENTS 7,648,851 B2 * 1/2010 Fu et al. ..... 438/64
2009/0102911 A1 * 4/2009 Koroishi et al. ..... 347/206

FOREIGN PATENT DOCUMENTS

JP 2009286063 12/2009

* cited by examiner

*Primary Examiner* — Huan Tran
(74) *Attorney, Agent, or Firm* — Adams & Wilks

(57) ABSTRACT

In order to secure printing quality, a head unit includes a thermal head having a heating body formed on one surface of a glass substrate made of a transparent glass material, the heating body being configured to generate heat when supplied with external power, and a support body is laminated onto the glass substrate in a stacked state. The glass substrate and the support body include a plurality of lamination reference marks and a plurality of head positioning reference marks, respectively, which are disposed so as to be mutually aligned in a direction along the one surface of the glass substrate.

9 Claims, 13 Drawing Sheets

LAMINATION POSITION OF THERMAL HEAD

HEAD UNIT, PRINTER, AND METHOD OF MANUFACTURING HEAD UNIT

BACKGROUND OF THE INVENTION

1. Field of the Invention

The present invention relates to a head unit, a printer, and a method of manufacturing a head unit.

2. Description of the Related Art

There has been conventionally known a head unit for use in thermal printers, which includes a thermal head and a support body that supports the thermal head (see, for example, Japanese Patent Application Laid-open No. 2009-286063). Printing quality of the thermal printer is affected by the accuracy of lamination between the thermal head and the support body in the head unit. In the method of manufacturing a head unit described in Japanese Patent Application Laid-open No. 2009-286063, a jig having a plurality of positioning pins is used, and the thermal head is placed on top of the support body to provide three-point support with common positioning pins, to thereby laminate the thermal head and the support body to each other in a positioned state.

The conventional method of manufacturing a thermal head, however, has a disadvantage that, if there are fluctuations in external shape of the thermal head (such as a crack and an inclination on the outer edge part of the thermal head) or if the contact positions between the thermal head and the respective positioning pins are deviated, the thermal head and the support body cannot be laminated to each other in an accurately positioned state.

Further, the accuracy of lamination between the thermal head and the support body is low, with the result that there is a problem that it is difficult to secure printing quality of a printer.

SUMMARY OF THE INVENTION

The present invention has been made in view of the above-mentioned circumstances, and it is an object of the present invention to provide a head unit capable of securing printing quality of a printer, and also provide a printer capable of realizing high printing quality. Further, it is another object of the present invention to provide a manufacturing method capable of manufacturing such head unit with ease without increasing manufacturing cost.

In order to achieve the above-mentioned objects, the present invention provides the following measures.

The present invention provides a head unit including: a thermal head, including a heating body formed on one surface of a glass substrate made of a transparent glass material, the heating body being configured to generate heat when supplied with external power; and a support body which is laminated onto the glass substrate in a stacked state, in which the glass substrate and the support body each include a plurality of positioning marks which are disposed so as to be mutually aligned in a direction along the one surface of the glass substrate.

According to the present invention, the thermal head having the heating body formed on the one surface of the glass substrate and the support body are laminated to each other in a plate thickness direction, to thereby constitute the head unit. Based on the plurality of positioning marks, the glass substrate and the support body are positioned in the direction along the one surface of the glass substrate. The thermal head and the support body are thus laminated to each other with high accuracy. Therefore, the thermal head can be mounted in a printer so that a center position of the heating body of the thermal head and a center position of a roller for pressing a thermal recording medium against the heating body may be brought into contact with each other with good accuracy, to thereby secure printing quality of the printer.

In the above-mentioned invention, the plurality of positioning marks of the glass substrate may be disposed so as to correspond to a center position of the heating body, and the plurality of positioning marks of the support body may be disposed so as to correspond to a reference position indicating a position as a reference for the support body.

With this configuration, the center position of the heating body and the reference position of the support body correspond to each other with reference to the positioning marks. Therefore, the thermal head can be mounted in the printer with good accuracy so that the center position of the heating body of the thermal head and the center position of the roller are aligned with each other.

Further, in the above-mentioned invention, the glass substrate may include two thin substrates which are bonded to each other in a stacked state, and at least one of the two thin substrates may have a concave portion opened in a bonding surface in a region opposed to the heating body.

With this configuration, the thin substrate having the heating body formed on the surface thereof functions as a heat storage layer that stores heat generated by the heating body. On the other hand, the opening of the concave portion formed in the bonding surface of the thin substrate is closed when the thin substrates are bonded to each other, to thereby form a cavity portion. The cavity portion is formed in the region opposed to the heating body and hence functions as a hollow heat insulating layer that prevents the heat generated by the heating body from transferring toward the support body side via the thin substrate. Therefore, owing to the cavity portion, of an amount of heat generated by the heating body, an amount of heat transferring toward the support body side can be reduced, whereas an amount of heat transferring to the side opposite to the support body can be increased, to thereby increase printing efficiency.

The present invention provides a printer including: the head unit according to the present invention; and a roller for feeding a thermal recording medium while pressing the thermal recording medium against the heating body of the thermal head.

According to the present invention, the head unit in which the thermal head and the support body are laminated to each other with high accuracy is used, and hence a deviation amount of a contact position between the center of the heating body and the center of the roller can be reduced to realize high printing quality.

The present invention provides a method of manufacturing a head unit, including: forming positioning marks on one surface of a glass substrate made of a transparent glass material; forming positioning marks on one surface of a support body; and laminating the glass substrate and the support body to each other in a stacked state so that the positioning marks of the glass substrate and the positioning marks of the support body are mutually aligned in a direction along the one surface of the glass substrate.

According to the present invention, the head unit in which the thermal head is stacked onto the support body in a plate thickness direction is manufactured. The transparent glass substrate is used, and hence in the laminating step, the positioning marks of the glass substrate and the positioning marks of the support body can be visually confirmed under a state in which the thermal head and the support body are disposed in an overlapping manner in the plate thickness direction.

Therefore, the glass substrate and the support body can be laminated to each other with high accuracy under the positioned state in the direction along the one surface of the glass substrate. With this, the head unit capable of securing printing quality can be manufactured with ease without using an expensive apparatus.

In the above-mentioned invention, the forming of the positioning marks of the glass substrate may include forming the positioning marks on the one surface of the glass substrate at the same time as forming a heating body, and the forming of the positioning marks of the support body may include forming the positioning marks at the same time as processing an external shape of the support body.

With this configuration, the positioning marks of the glass substrate and the positioning marks of the support body can be formed efficiently.

Further, in the above-mentioned invention, the forming of the positioning marks of the glass substrate may include forming the positioning marks so as to correspond to a center position of the heating body, and the forming of the positioning marks of the support body may include forming the positioning marks so as to correspond to a reference position indicating a position as a reference for the support body.

With this configuration, in the laminating step, the glass substrate and the support body can be laminated to each other so that the center position of the heating body and the reference position of the support body correspond to each other with reference to the positioning marks. Therefore, it is possible to manufacture a head unit with which, when mounted in a printer, the center position of the heating body of the thermal head and the center position of a roller can be aligned with each other with ease.

Further, the above-mentioned invention may further include: bonding two thin substrates to each other in a stacked state, at least one of which has a concave portion formed in a surface, so as to close an opening of the concave portion, to thereby form the glass substrate; and forming the heating body on the glass substrate in a region opposed to the concave portion formed in the at least one of the two thin substrates.

With this configuration, in the bonding step, the glass substrate having a cavity portion at bonding surfaces of the thin substrates is formed. The cavity portion is formed in the thin substrate in the region opposed to the heating body, and hence functions as a hollow heat insulating layer that prevents heat generated by the heating body from transferring toward the support body side via the thin substrate.

Therefore, it is possible to manufacture a head unit in which, owing to the cavity portion, of an amount of heat generated by the heating body, an amount of heat transferring toward the support body side can be reduced, whereas an amount of heat transferring to the side opposite to the support body can be increased, to thereby increase printing efficiency.

The present invention provides the effect that printing quality of a printer can be secured. Further, the present invention provides the effect that the head unit in which the thermal head and the support body are laminated to each other with good accuracy can be manufactured with each without increasing manufacturing cost.

DETAILED DESCRIPTION OF THE PREFERRED EMBODIMENTS

First Embodiment

Now, a head unit, a printer, and a method of manufacturing a head unit according to a first embodiment of the present invention are described below with reference to the accompanying drawings.

Figure 1:
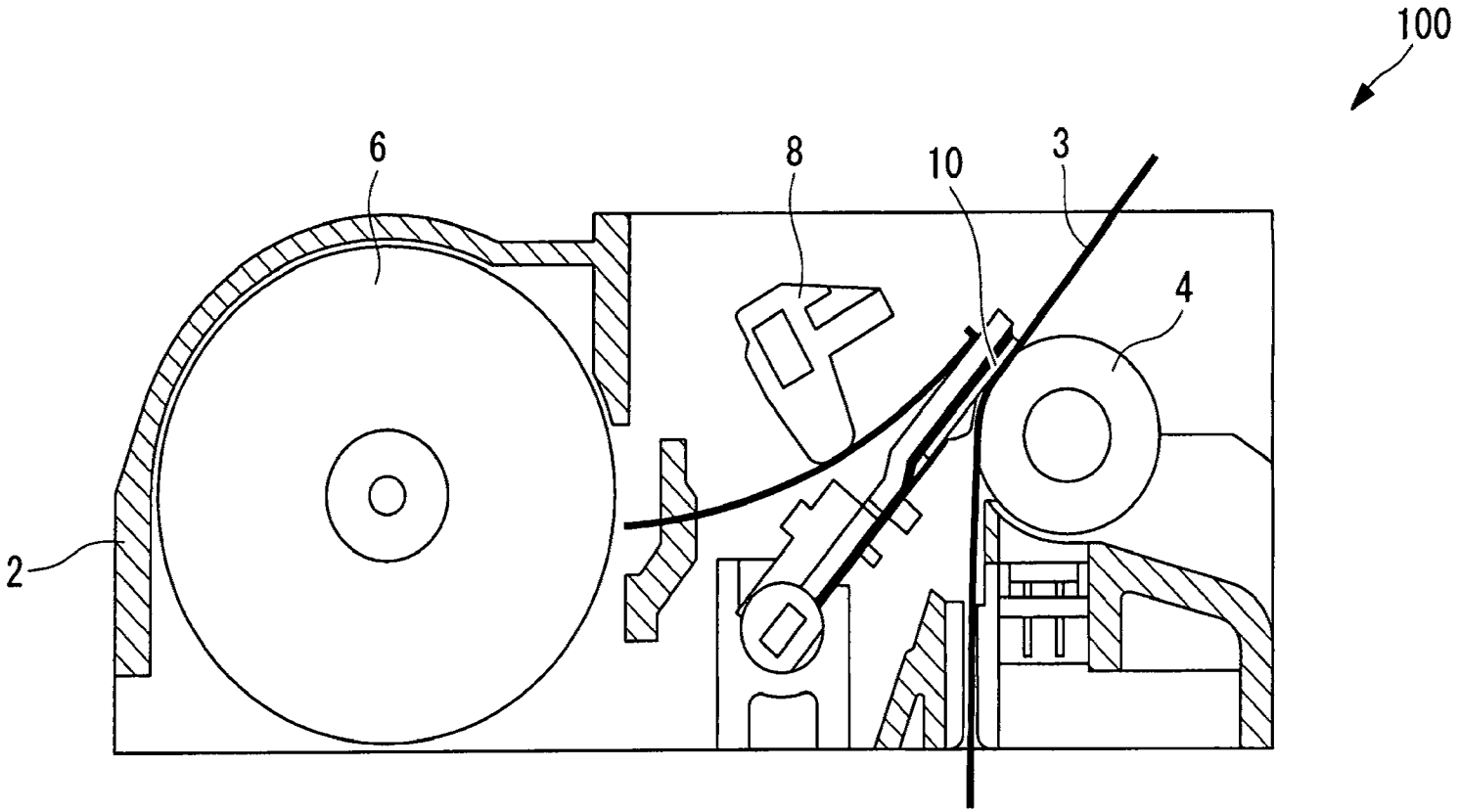
FIG. 1 is a schematic structural view of a thermal printer according to a first embodiment of the present invention.

A thermal printer (printer) 100 according to this embodiment includes, as illustrated in FIG. 1, a main body frame 2, a platen roller 4 disposed horizontally to the main body frame 2, a head unit 10 disposed so as to be opposed to an outer peripheral surface of the platen roller 4, a paper feeding mechanism 6 for feeding an object to be printed, such as thermal paper (thermal recording medium) 3, between the platen roller 4 and the head unit 10, and a pressure mechanism 8 for pressing the head unit 10 against the platen roller 4 through the intermediation of the thermal paper 3 with a predetermined pressing force.

Against the platen roller 4, the thermal paper 3 and the head unit 10 are pressed by the operation of the pressure mechanism 8. Accordingly, a load of the platen roller 4 is applied to the head unit 10 via the thermal paper 3.

Figure 2:
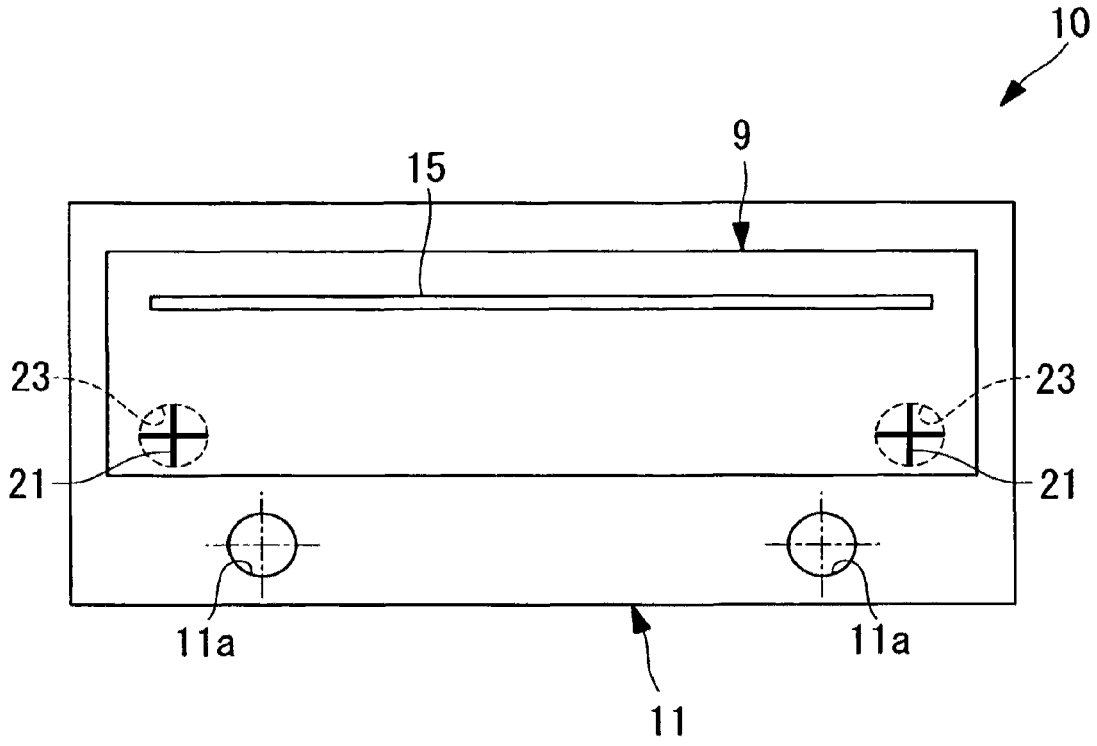
FIG. 2 is a view of a head unit of FIG. 1 viewed in a stacking direction from a thermal head side.

As illustrated in FIG. 2, the head unit 10 includes a plate-shaped thermal head 9 for performing printing on the thermal paper 3 and the like and a plate-shaped support body 11 that supports the thermal head 9. The thermal head 9 and the support body 11 are laminated to each other in a plate thickness direction in a stacked state.

Figure 3:
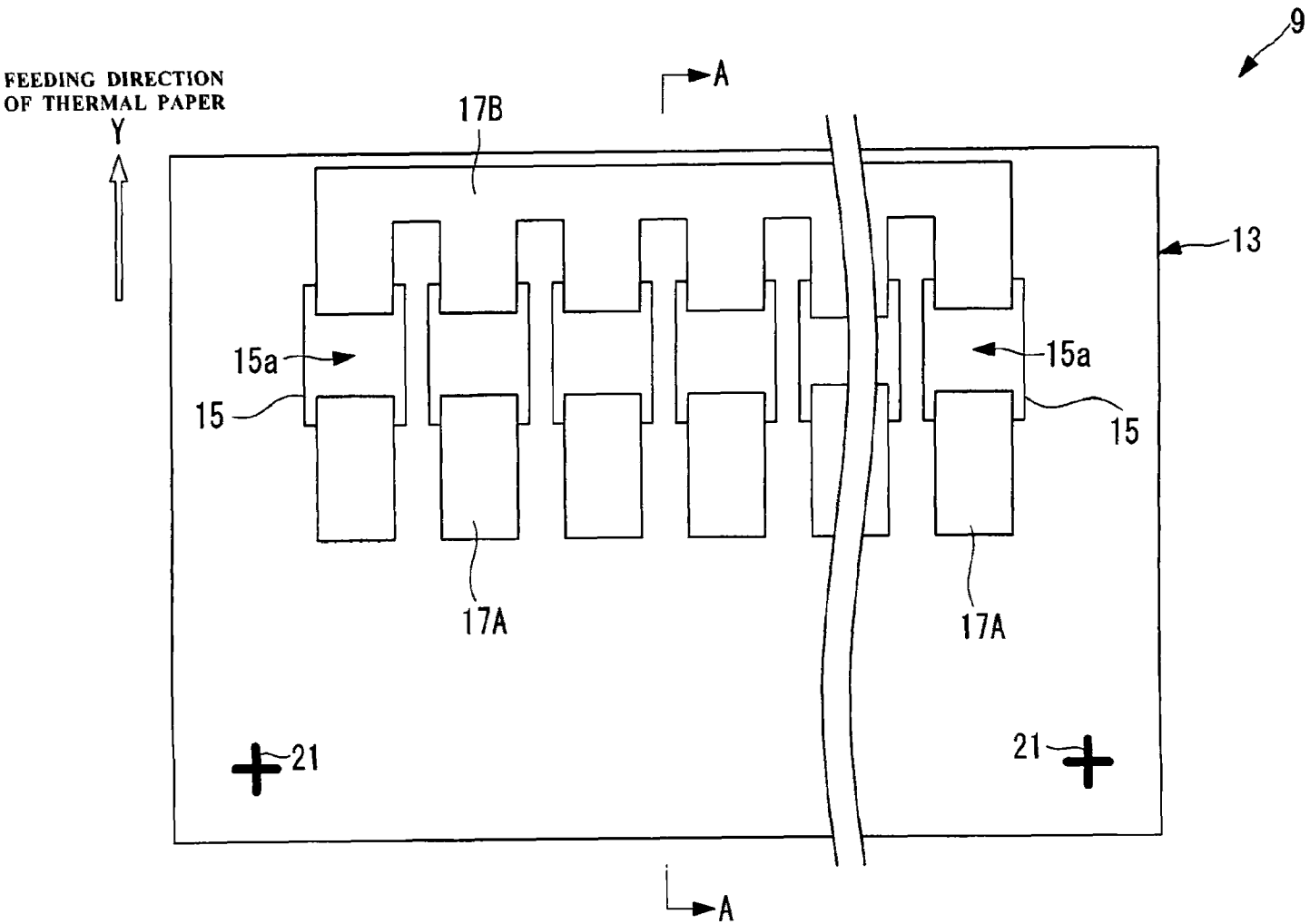
FIG. 3 is a view of the thermal head of FIG. 2 viewed in the stacking direction from a protective film side.
Figure 4:
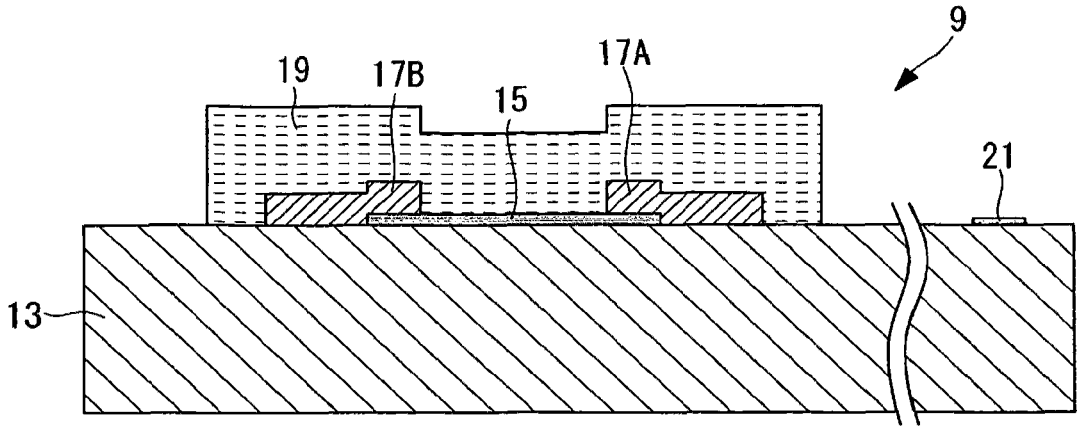
FIG. 4 is a cross-sectional view of the thermal head taken along the line A-A of FIG. 3.

As illustrated in FIGS. 3 and 4, the thermal head 9 includes a plate-shaped glass substrate 13, a plurality of heating bodies 15 formed on one surface of the glass substrate 13, electrode portions 17A and 17B connected to both ends of the heating bodies 15, and a protective film 19 for covering the heating bodies 15 and the electrode portions 17A and 17B on the glass substrate 13. In the drawings, the arrow Y represents a feeding direction of the thermal paper 3 by the platen roller 4.

Figure 5A:
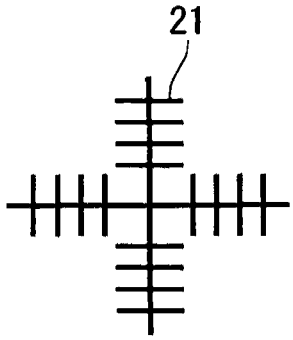
FIG. 5A is a diagram illustrating a lamination reference mark.

The glass substrate 13 is formed of a transparent glass material. On the one surface of the glass substrate 13 on which the heating bodies 15 are formed, there are formed two lamination reference marks (positioning marks) 21 having a predetermined shape. The lamination reference marks 21 have the shape of, for example, a graduated cross that crosses in the X and Y axis directions as illustrated in FIG. 5A. Those lamination reference marks 21 are disposed, for example, on the one surface of the glass substrate 13 in the vicinities of two corners at a distance from the heating bodies 15 in the width direction. Further, the lamination reference marks 21 are each formed of, for example, the same material as that of the heating bodies 15.

The plurality of heating bodies 15 are arrayed on the one surface of the glass substrate 13 at predetermined intervals along the longitudinal direction of the glass substrate 13. The heating body 15 is formed of, for example, a thin film of the material of the heating body, such as a Ta-based or silicide-based material.

The electrode portions 17A and 17B supply the heating bodies 15 with external power, thereby allowing the heating bodies 15 to generate heat. Further, the electrode portions 17A and 17B include a plurality of individual electrodes 17A individually connected to each of the heating bodies 15, and an integrated common electrode 17B integrally connected to all the heating bodies 15. Those electrode portions 17A and 17B are each formed of, for example, an electrode material such as Al, Al—Si, Au, Ag, Cu, or Pt.

When external power is supplied to any one of the individual electrodes 17A and a current is caused to flow to the common electrode 17B via a heating body 15 to which the individual electrode 17A is connected, the heating body 15 generates heat between the individual electrode 17A and the common electrode 17B. The heating body 15 has a heating portion corresponding to a region sandwiched by the individual electrode 17A and the common electrode 17B. The substantially center position of the heating portion is referred to as a heating body center 15*a*.

The protective film 19 is capable of protecting the heating bodies 15 and the electrode portions 17A and 17B on the glass substrate 13 from abrasion and corrosion. The protective film 19 is formed of a protective film material such as $SiO_2$, $Ta_2O_5$, SiAlON, $Si_3N_4$, or diamond-like carbon.

The support body 11 is a plate-shaped member made of a metal such as aluminum, a resin, ceramics, glass, or the like. The head unit 10 is fixed to the thermal printer 100 in a manner that the support body 11 is mounted thereto. On one surface of the support body 11 on which the thermal head 9 is laminated, as illustrated in FIG. 2, there are formed two head positioning reference marks (positioning marks) 23 having a predetermined shape and two reference positions 11*a* indicating a reference for the position of the support body 11.

Figure 5B:
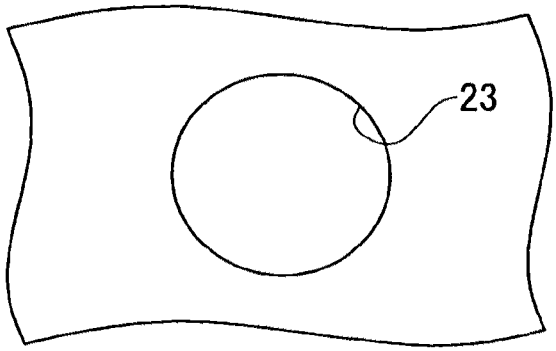
FIG. 5B is a diagram illustrating a head positioning reference mark.

The head positioning reference mark 23 is, for example, a round-punched through hole that passes through the support body 11 in the plate thickness direction. Further, the head positioning reference mark 23 has, for example, as illustrated in FIG. 5B, a diameter dimension which is slightly smaller than an external dimension of the lamination reference mark 21. The head positioning reference marks 23 are each disposed at, for example, a position that aligns with the lamination reference mark 21 in a direction along the one surface of the glass substrate 13 under a state in which the glass substrate 13 is laminated onto the support body 11.

The reference position 11*a* is, similarly to the head positioning reference mark 23, for example, a round-punched through hole that passes through the support body 11 in the plate thickness direction. The head positioning reference marks 23 and the reference positions 11*a* are each disposed at intervals in the longitudinal direction of the support body 11.

Figure 6:
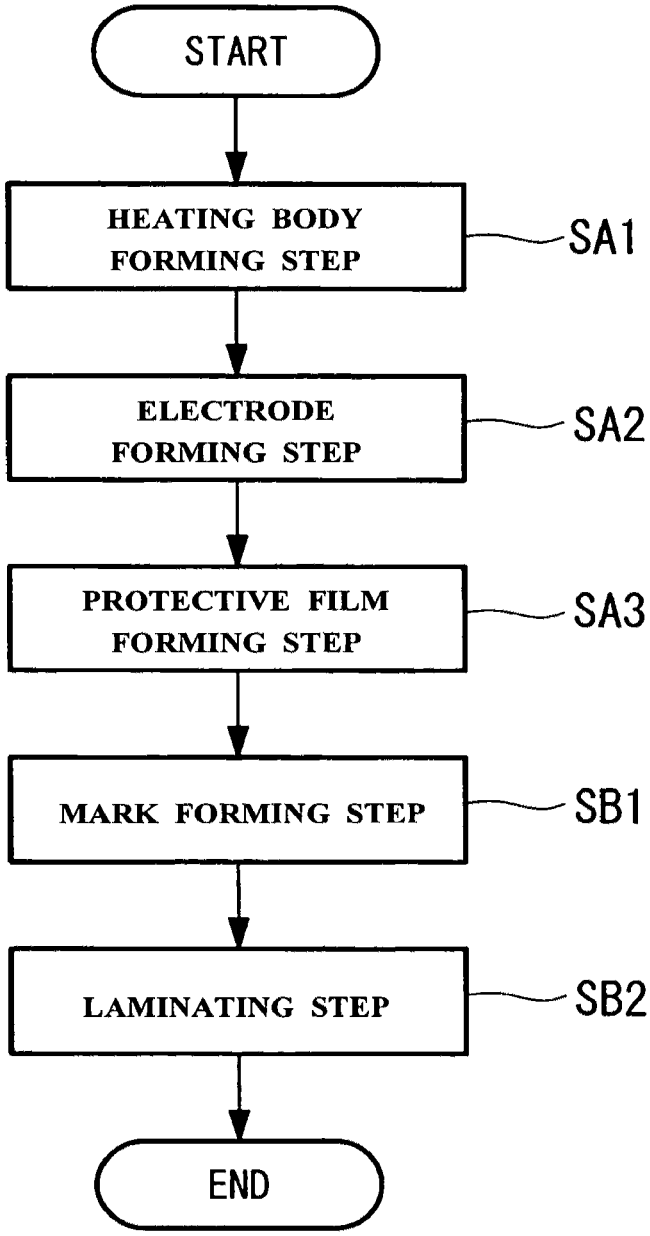
FIG. 6 is a flowchart illustrating manufacturing steps for the head unit according to the first embodiment of the present invention.

Next, a method of manufacturing the head unit 10 structured in this way is described with reference to a flowchart of FIG. 6.

The method of manufacturing the head unit 10 according to this embodiment is divided into a thermal head forming step of forming the thermal head 9 and a head unit forming step of forming the head unit 10 by using the thermal head 9.

The thermal head forming step includes a heating body forming step (substrate mark forming step) SA1 of forming the heating bodies 15 on the one surface of the glass substrate 13, an electrode forming step SA2 of forming the electrode portions 17A and 17B, and a protective film forming step SA3 of forming the protective film 19.

In the heating body forming step SA1, the plurality of heating bodies 15 are patterned on the one surface of the glass substrate 13 (Step SA1). To pattern the heating bodies 15, a thin film formation method such as sputtering, chemical vapor deposition (CVD), or deposition can be used. For example, a thin film of the material of the heating bodies is formed on the glass substrate 13, and the thin film is then shaped by lift-off, etching, or the like, to thereby form the heating bodies 15 having a desired shape.

In the heating body forming step SA1, at the same time as patterning the heating bodies 15, the lamination reference marks 21, which are provided in advance by mask design, are patterned on the same surface. It is desired that the lamination reference mark 21 be formed at such a position that is unrelated to the function of the thermal head 9 and easy to position the thermal head 9 and the support body 11 to each other. Based on the accuracy of the mask, the positions of the lamination reference marks 21 can be determined so as to correspond to the position of the heating body center 15*a*. Therefore, the lamination reference marks 21 can be formed at desired positions with high accuracy without fluctuations.

In the electrode forming step SA2, similarly to the heating body forming step SA1, an electrode material is formed on the glass substrate 13 by sputtering, deposition, or the like. Then, the film thus obtained is shaped by lift-off or etching, or alternatively the electrode material is baked after screen-printing, to thereby form the electrode portions 17A and 17B (Step SA2). The heating bodies 15 and the electrode portions 17A and 17B are formed in an arbitrary order.

In the protective film forming step SA3, a protective film material is formed on the surface of the glass substrate 13 on which the heating bodies 15 and the electrode portions 17A and 17B are formed, to thereby form the protective film 19 (Step SA3). The film formation method to be used is sputtering, ion plating, CVD, or the like.

Through the above-mentioned steps, the thermal head 9 is completed, in which the two lamination reference marks 21 are provided on the one surface of the transparent, plate-shaped glass substrate 13 on which the heating bodies 15, the electrode portions 17A and 17B, and the protective film 19 are formed.

Next, the head unit forming step includes a mark forming step (support body mark forming step) SB1 of forming the head positioning reference marks 23 on the one surface of the support body 11 and a laminating step SB2 of laminating the glass substrate 13 and the support body 11 to each other in a stacked state.

In the mark forming step SB1, for example, the same die is used to form the head positioning reference marks 23 at the same time as processing the external shape of the support body 11. In this way, based on the processing accuracy of the die, the positions of the head positioning reference marks 23 can be determined without fluctuations.

Further, in the mark forming step SB1, the punched holes of the head positioning reference marks 23 are also processed in a die so as to correspond to the reference positions 11*a*. In this way, the head positioning reference marks 23 can be formed with good accuracy so as to correspond to the reference positions 11*a*.

In the laminating step SB2, the thermal head 9 and the support body 11 are laminated to each other under a state in which the lamination reference marks 21 and the head positioning reference marks 23 are positioned so as to be mutually aligned in the direction along the one surface of the glass substrate 13 (Step SB2). Specifically, double-faced tape is attached to the support body 11 at a position to be laminated onto the thermal head 9, and the support body 11 is firmly placed onto a customized simple jig (not shown). Then, the thermal head 9 is placed on top of the support body 11 at the lamination position thereof.

In this case, the transparent glass substrate 13 is used, and hence the lamination reference marks 21 and the head positioning reference marks 23 can be visually confirmed under the state in which the thermal head 9 and the support body 11 are disposed in an overlapping manner in the plate thickness direction.

Figure 7:
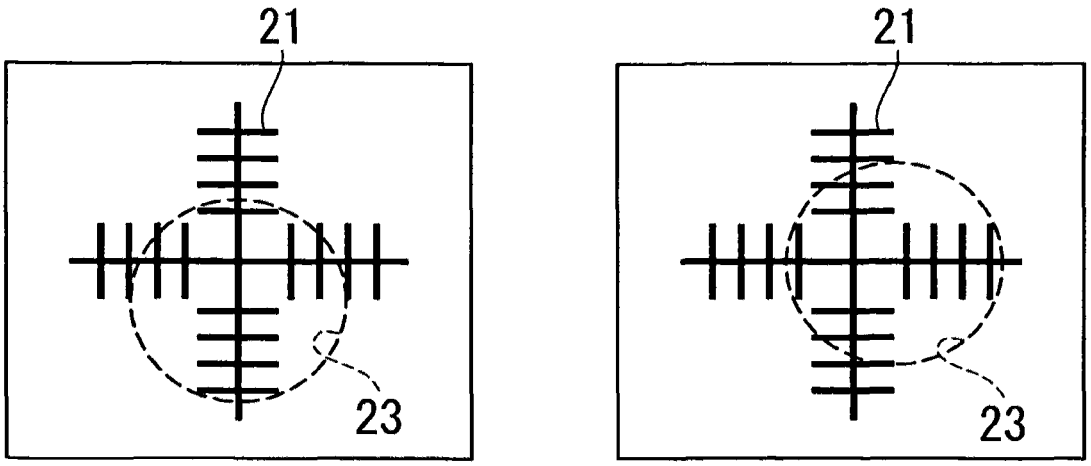
FIG. 7 is a diagram illustrating right and left lamination reference marks and right and left head positioning reference marks displayed on monitors through a microscope.

Here, for example, a microscope (not shown) set to an optimum magnification is used to display right and left lamination reference marks 21 and right and left head positioning reference marks 23 on two monitors as illustrated in FIG. 7. Then, using the scale of the lamination reference mark 21 as a guide, the positions of the lamination reference mark 21 and the head positioning reference mark 23 are adjusted in the X and Y axis directions and the rotational direction.

Figure 8:
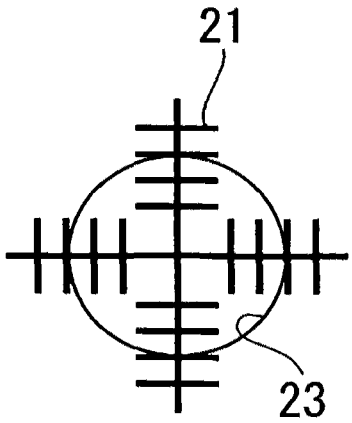
FIG. 8 is a diagram illustrating a state in which the lamination reference mark and the head positioning reference mark are substantially aligned with each other in a direction along one surface of a glass substrate.

The scale provided to the lamination reference mark 21 enables quantitative adjustment of a vertical and horizontal deviation amount. The adjustment may be performed by handling the thermal head 9, or alternatively may be performed through a dial of an XY table (not shown) of the simple jig. In this way, as illustrated in FIG. 8, the center of each of the head positioning reference marks 23 is aligned with the center of each of the lamination reference marks 21, to thereby determine the lamination position.

Figure 9:
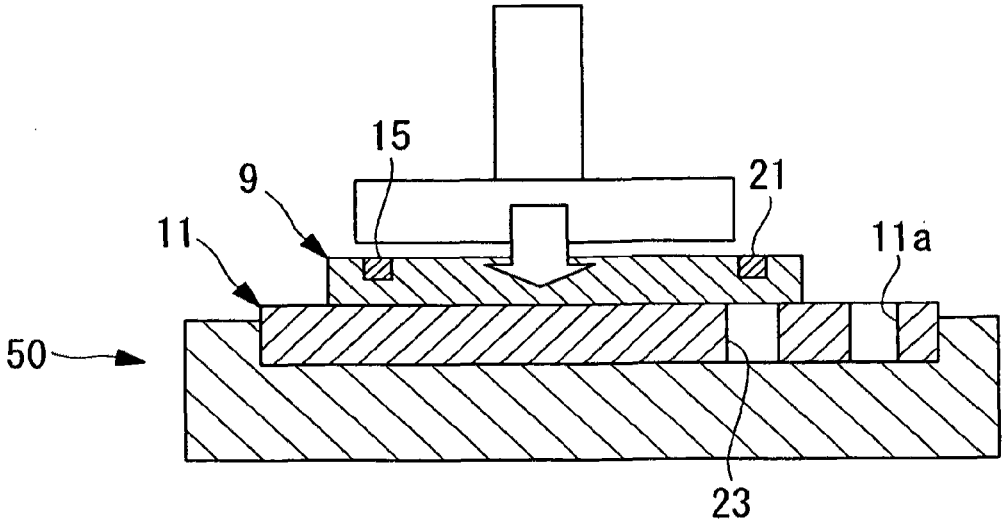
FIG. 9 is a diagram illustrating how the head unit is pressed against the support body in a state in which the head unit is positioned with respect to the support body.

After the lamination position is determined, the thermal head 9 is temporarily laminated and fixed to the support body 11 by double-faced tape. After that, the support body 11 is detached from the simple jig and then mounted onto another main pressure bonding jig 50. Then, as illustrated in FIG. 9, the thermal head 9 is pressed against the support body 11 for an optimum time period at optimum temperature and pressure to fix the thermal head 9 to the support body 11. In this way, the head unit 10 is completed, in which the thermal head 9 is laminated to the support body 11 in the plate thickness direction.

Hereinafter, operations of the head unit 10 structured in this way and the thermal printer 100 are described.

In printing on the thermal paper 3 using the thermal printer 100 according to this embodiment, first, a voltage is selectively applied to the individual electrodes 17A of the thermal head 9. Then, a current flows through the heating bodies 15 which are connected to the selected individual electrodes 17A and the common electrode 17B opposed thereto, to thereby allow the heating bodies 15 to generate heat.

Subsequently, the platen roller 4 rotates about an axis parallel to the array direction of the heating bodies 15, to thereby feed the thermal paper 3 toward the Y direction orthogonal to the array direction of the heating bodies 15. The pressure mechanism 8 is operated to press the heating bodies 15 of the thermal head 9 against the thermal paper 3 so that color is developed on the thermal paper 3, to thereby perform printing.

Figure 10:
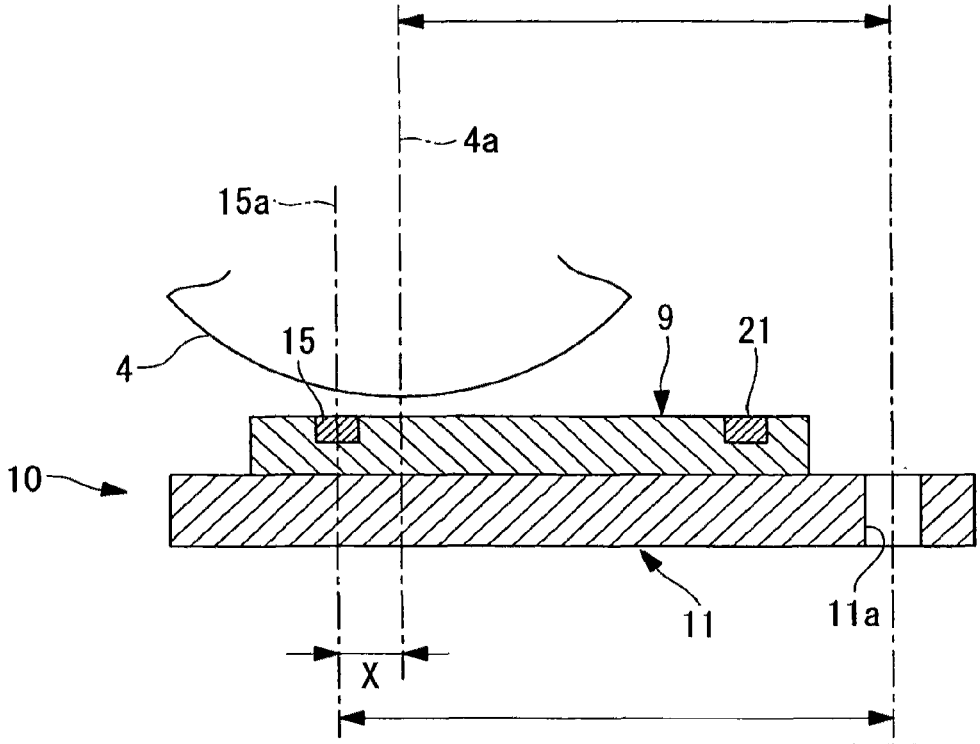
FIG. 10 is a diagram illustrating a deviation between a heating body center and a center position of a platen roller.

Here, in the thermal printer 100, in order to secure printing quality, a deviation amount (hereinafter, referred to as offset amount X) as illustrated in FIG. 10 between the heating body center 15*a* of the thermal head 9 and a center position 4*a* of the platen roller 4 needs to be zero. In general, the positional relationship between the center position 4*a* of the platen roller 4 and the support body 11 is mechanically determined according to the reference positions 11*a* of the support body 11 based on the shape of the mechanism and the dimensions of the member. Therefore, the accuracy of the offset amount X is determined by the accuracy of lamination of the thermal head 9 with respect to the support body 11, with reference to the position of the heating body center 15*a*.

Figure 11:
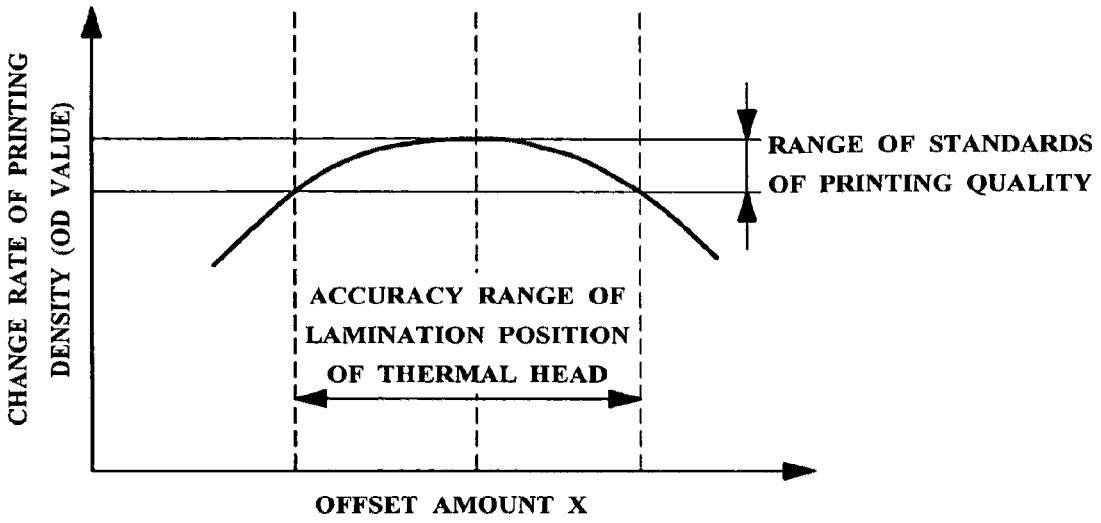
FIG. 11 is a graph illustrating a relationship between an offset amount and a change rate of printing density.

FIG. 11 illustrates a change rate of printing density (OD value) of the thermal printer 100 with respect to the offset amount X. In order to secure printing quality of a certain level, it is necessary to reduce fluctuations in printing density within a range of standards of the printing quality. The accuracy of lamination of the thermal head 9 with respect to the support body 11 thus needs to be within a certain range. In general, the offset amount X needs to be within ±0.1 mm.

According to the method of manufacturing the head unit 10 of this embodiment, by using the two lamination reference marks 21 and the two head positioning reference marks 23, the glass substrate 13 and the support body 11 can be laminated to each other with high accuracy under the positioned state in the direction along the one surface of the glass substrate 13. Therefore, the head unit 10 can be mounted in the thermal printer 100 so that the heating body center 15*a* of the thermal head 9 and the center position 4*a* of the platen roller 4 may be brought into contact with each other with good accuracy.

As a result, according to the head unit 10 and the thermal printer 100, the fluctuations in printing density can be suppressed to secure high printing quality.

Further, the head unit 10 described above can be manufactured with ease without using an expensive apparatus, and hence it is possible to respond flexibly to various types of printers and fluctuations in production volume.

Second Embodiment

Next, a head unit, a printer, and a method of manufacturing a head unit according to a second embodiment of the present invention are described.

Figure 12:
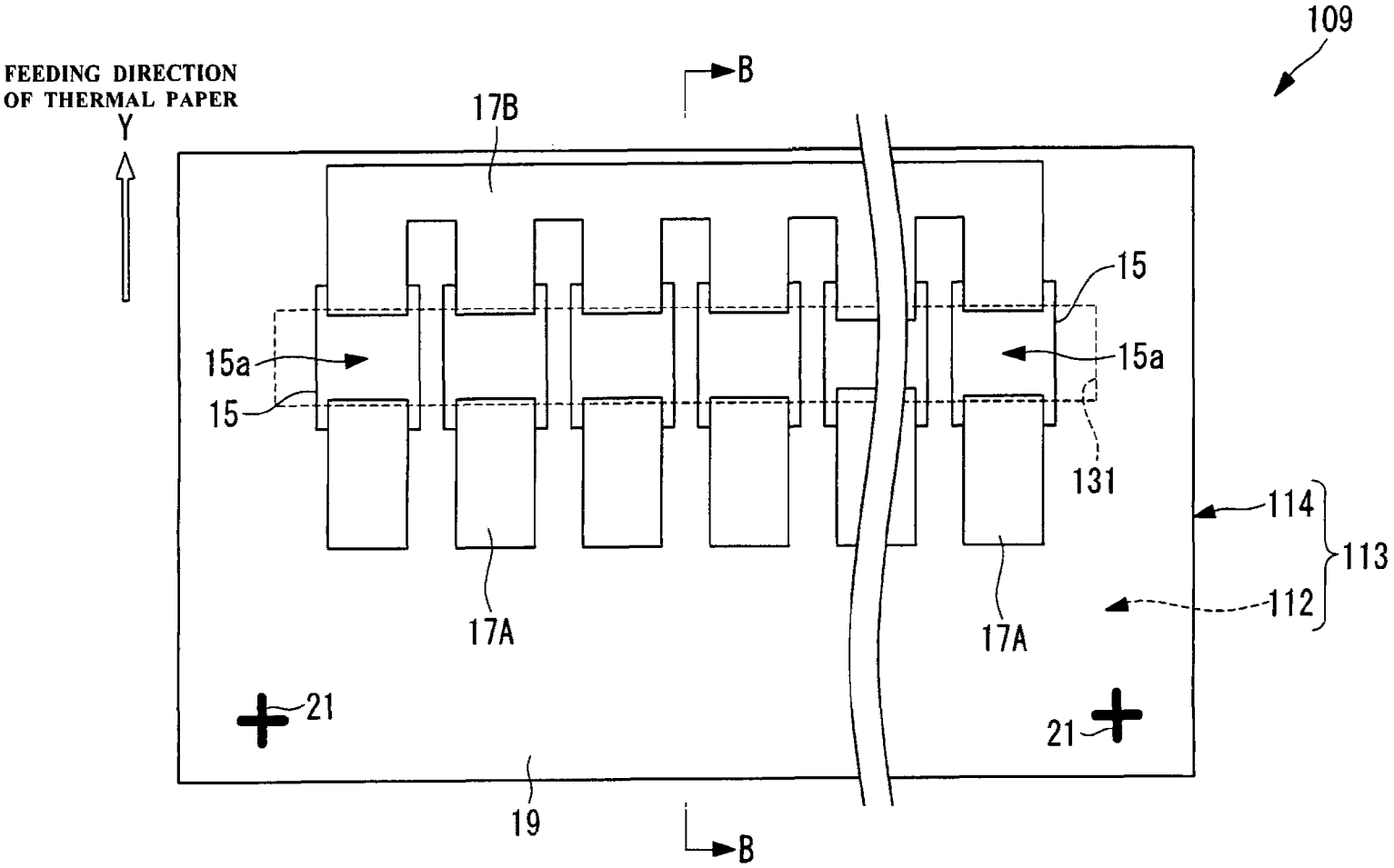
FIG. 12 is a view of a thermal head according to a second embodiment of the present invention viewed in a stacking direction from a protective film side.
Figure 13:
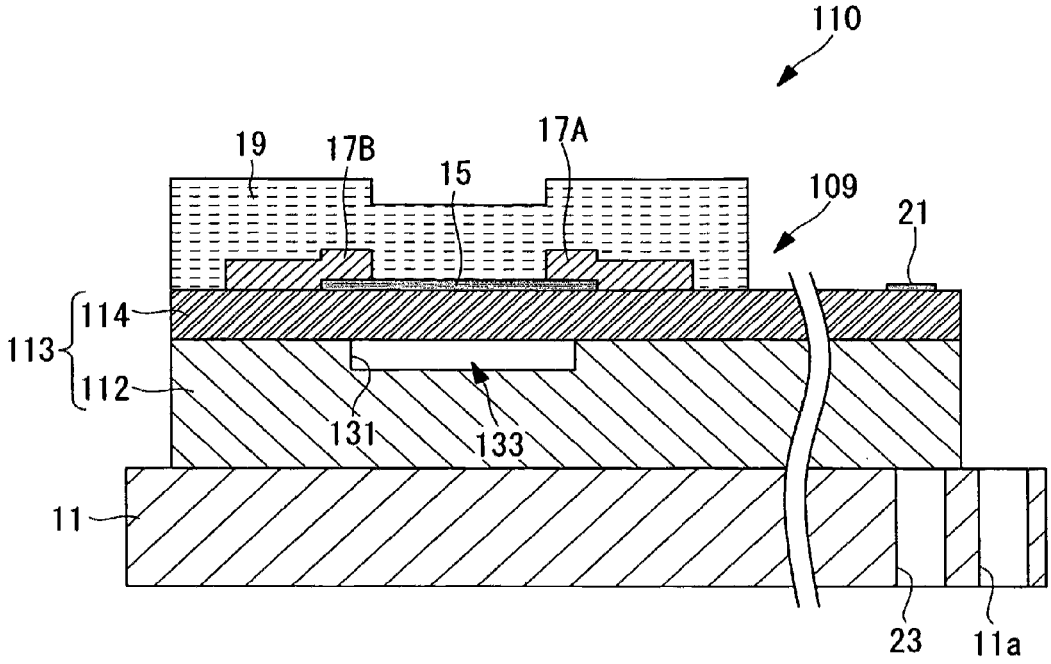
FIG. 13 is a cross-sectional view of the thermal head taken along the line B-B of FIG. 12.

A head unit 110 according to this embodiment is different from the head unit according to the first embodiment in that, as illustrated in FIGS. 12 and 13, a glass substrate 113 includes two thin substrates 112 and 114 which are bonded to each other in a stacked state and that the glass substrate 113 has a hollow structure.

Hereinafter, portions common in structure to those of the head unit 10, the thermal printer 100, and the method of manufacturing the head unit 10 according to the first embodiment are denoted by the same reference symbols and description thereof is omitted.

The glass substrate 113 includes the elongated plate-shaped thin substrate (hereinafter, referred to as "support substrate") 112, which is fixed to the support body 11, and the elongated plate-shaped thin substrate (hereinafter, referred to as "upper substrate") 114, which is bonded to one surface of the support substrate 112 in a stacked state. The support substrate 112 and the upper substrate 114 are each formed of a transparent glass material.

The support substrate 112 has a thickness approximately ranging, for example, from 300 μm to 1 mm. In the support substrate 112, a concave portion 131 which is opened in a bonding surface to the upper substrate 114 is formed. The concave portion 131 is formed into a rectangular shape extending along the longitudinal direction of the support substrate 112.

The upper substrate 114 has a thickness approximately ranging from 10 μm to 100 μm. The opening of the concave portion 131 of the support substrate 112 is closed by the upper substrate 114 to form a cavity portion 133 in a bonding portion between the support substrate 112 and the upper substrate 114.

The plurality of heating bodies 15 are arrayed on one surface of the upper substrate 114 at predetermined intervals along the longitudinal direction of the upper substrate 114, that is, the longitudinal direction of the concave portion 131 of the support substrate 112. The heating bodies 15 are each provided so as to straddle the concave portion 131 in its width direction.

The respective individual electrodes 17A and the common electrode 17B are provided so as to be opposed to each other in the width direction of the concave portion 131.

Figure 14:
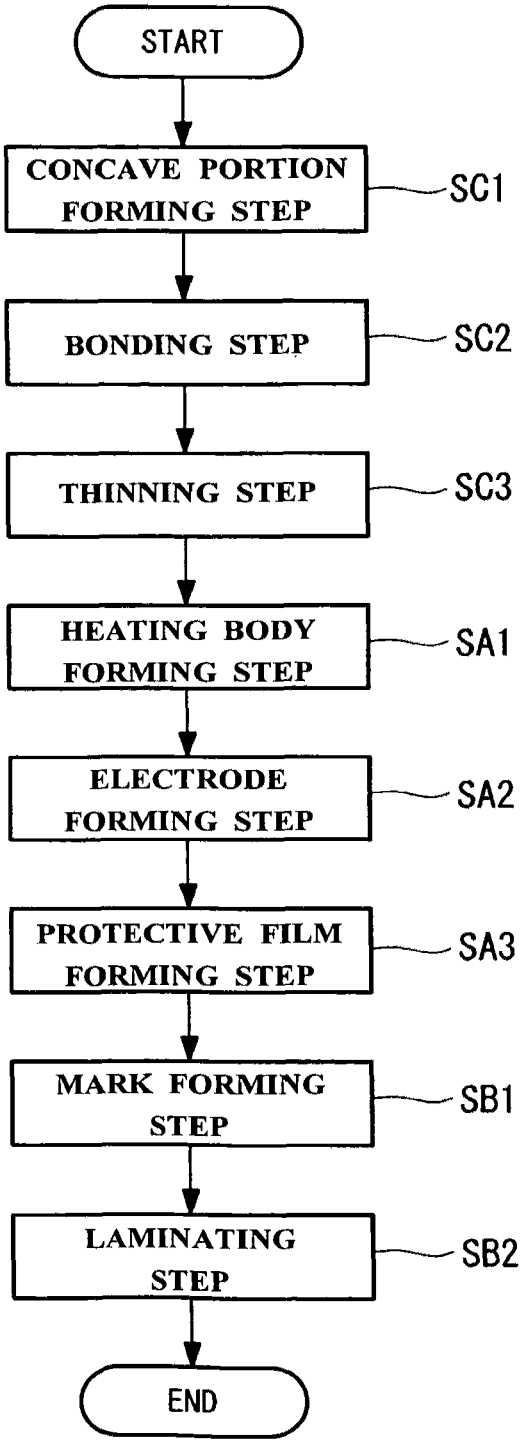
FIG. 14 is a flowchart illustrating manufacturing steps for a head unit according to the second embodiment of the present invention.

Next, a method of manufacturing the head unit 110 structured in this way is described with reference to a flowchart of FIG. 14.

In the method of manufacturing the head unit 110 according to this embodiment, the thermal head forming step includes a concave portion forming step SC1 of forming the concave portion 131 in the one surface of the support substrate 112, a bonding step SC2 of bonding the support substrate 112 and the upper substrate 114 to each other, and a thinning step SC3 of thinning the upper substrate 114.

In the concave portion forming step SC 1, the concave portion 131 is formed in the one surface of the support substrate 112 in a region to be opposed to the heating bodies 15 formed in the heating body forming step SA1 (Step SC1). The concave portion 131 can be formed by performing, for example, sandblasting, dry etching, wet etching, laser machining, or drill machining on the surface of the support substrate 112.

When sandblasting is performed, the one surface of the support substrate 112 is covered with a photoresist material. Then, the photoresist material is exposed to light using a photomask of a predetermined pattern so as to be cured in part other than the region for forming the concave portion 131. After that, the surface of the support substrate 112 is cleaned and the uncured photoresist material is removed. Thus, an etching mask (not shown) having an etching window formed in the region for forming the concave portion 131 can be obtained. In this state, sandblasting is performed on the surface of the support substrate 112 to form the concave portion 131 having a predetermined depth.

Further, when etching, such as dry etching and wet etching, is performed, similarly to the above-mentioned processing by sandblasting, the etching mask having the etching window formed in the region for forming the concave portion 131 is formed on the one surface of the support substrate 112. In this state, etching is performed on the surface of the support substrate 112 to form the concave portion 131 having a predetermined depth.

As such an etching process, for example, wet etching using a hydrofluoric acid-based etchant or the like is available, as well as dry etching such as reactive ion etching (RIE) and plasma etching. As a reference example, in a case of a single-crystal silicon support substrate, wet etching may be performed using an etchant such as a tetramethylammonium hydroxide solution, a KOH solution, or a mixed solution of hydrofluoric acid and nitric acid.

In the bonding step SC2, to the one surface of the support substrate 112 in which the concave portion 131 is formed, the flat plate-shaped glass (upper substrate) 114 having a thickness of, for example, 100 μm or larger is bonded (Step SC2). A thin glass substrate having a thickness of 100 μm or smaller is difficult to manufacture and handle, and expensive. Thus, instead of bonding an originally thin upper substrate 114 onto the support substrate 112, the upper substrate 114 which is thick enough to be easily manufactured and handled is bonded onto the support substrate 112. After that, the upper substrate 114 is processed to a desired thickness in the thinning step SC3.

In the bonding step SC2, first, etching masks are all removed from the surface of the support substrate 112, followed by cleaning. Then, the upper substrate 114 is laminated to the surface of the support substrate 112 so as to close the concave portion 131. For example, the upper substrate 114 is directly laminated to the support substrate 112 at room temperature without using an adhesive layer. In this state, the laminated support substrate 112 and upper substrate 114 are subjected to heating treatment so as to be bonded to each other through thermal fusion.

In the thinning step SC3, the upper substrate 114 of the glass substrate 13 is thinned to a desired thickness (Step SC3). The thinning of the upper substrate 114 is performed by etching, polishing, or the like. For the etching of the upper substrate 114, various types of etching can be used as in the concave portion forming step SC1. Further, for the polishing of the upper substrate 114, for example, chemical mechanical polishing (CMP), which is used for high accuracy polishing for a semiconductor wafer and the like, can be used.

Through the above-mentioned steps, the glass substrate 113 having the cavity portion 133 at the bonding portion between the support substrate 112 and the upper substrate 114 is formed. The other steps for manufacturing the head unit 110 are the same as those in the method of manufacturing the head unit 10 according to the first embodiment, and hence description thereof is omitted.

According to the head unit 110 structured in this way, the upper substrate 114 having the heating bodies 15 formed on the surface thereof functions as a heat storage layer that stores heat generated by the heating bodies 15. On the other hand, the cavity portion 133 formed in the region opposed to the heating bodies 15 functions as a hollow heat insulating layer that prevents the heat generated by the heating bodies 15 from transferring toward the support body 11 via the upper substrate 112.

Therefore, with the cavity portion 133, of an amount of heat generated by the heating bodies 15, an amount of heat transferring toward the support body 11 side can be reduced, whereas an amount of heat transferring to the side opposite to the support body 11, that is, toward the protective film 19 side can be increased. In this way, printing efficiency can be increased in addition to bringing the heating body center 15*a* and the center position 4*a* of the platen roller 4 into contact with each other with good accuracy, to thereby realize high printing quality.

In this embodiment, the upper substrate 114 is thinned in the thinning step SC3. As an alternative thereto, an originally thin upper substrate 114 having a desired thickness may be employed. This can omit the thinning step SC3. Further, in this embodiment, the concave portion 131 is formed in the one surface of the support substrate 112. Alternatively, however, it is only necessary to provide the concave portion 131 in at least one of the support substrate 112 and the upper substrate 114. For example, the concave portion 131 may be provided in the upper substrate 114 at the bonding surface to the support substrate 112, or the concave portion 131 may be provided in both the support substrate 112 and the upper substrate 114 at the bonding surfaces.

Hereinabove, the embodiments of the present invention have been described in detail with reference to the accompanying drawings. However, specific structures of the present invention are not limited to the embodiments and encompass design modifications and the like without departing from the gist of the present invention. For example, each of the above-mentioned embodiments has exemplified two lamination reference marks 21 and two head positioning reference marks 23, but the number of the lamination reference marks 21 and the number of the head positioning reference marks 23 are not limited as long as the number is more than one.

Figure 15A:
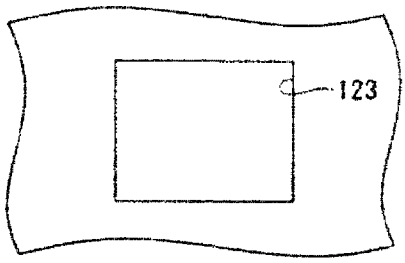
FIG. 15A is a modified example of the head positioning reference mark.

Further, for example, each of the above-mentioned embodiments has exemplified, as the positioning marks, the lamination reference marks 21 having the shape of a graduated cross and the round-punched head positioning reference marks 23. However, those positioning marks may be in any combination of such shapes (easy-to-see shapes) that facilitate vertical and horizontal adjustment. For example, the positioning mark of the support body 11 may be a square-punched head positioning reference mark 123 as illustrated in FIG. 15A.

Figure 15B:
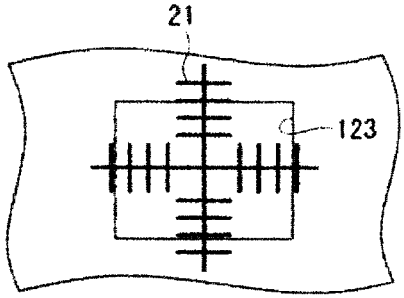
FIG. 15B is a diagram illustrating a state in which the lamination reference mark according to the embodiments of the present invention and the head positioning reference mark of FIG. 15A are aligned with each other in the direction along the one surface of the glass substrate.

When the positioning mark of the support body 11 has the round-punched or square-punched shape, punching processing can be stably performed on a die. Therefore, the load on the die is reduced and the durability of the die can be secured. Further, even in the case of the square-punched head positioning reference mark 123, as illustrated in FIG. 15B, similarly to the case of employing the round-punched head positioning reference mark 23, quantitative adjustment of a vertical and horizontal deviation amount can be performed by the scale provided.

Figure 16A:
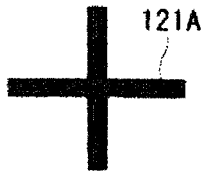
FIG. 16A is a diagram illustrating a modified example of the lamination reference mark.
Figure 16B:
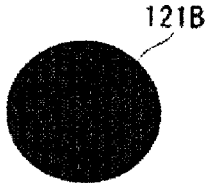
FIG. 16B is a diagram illustrating another modified example of the lamination reference mark.

Further, for example, with respect to the round-punched or square-punched head positioning reference mark 23 or 123, it is possible to employ, as illustrated in FIG. 16A, a thick line lamination reference mark 121A of a cross shape having an external dimension which is substantially the same as the external dimension of the head positioning reference mark 23 or 123, or alternatively, as illustrated in FIG. 16B, a lamination reference mark 121B of a round shape having an external dimension which is slightly smaller than the external dimension of the head positioning reference mark 23 or 123. The lamination reference marks 21, 121A, and 121B, each of which has such a shape that facilitates vertical and horizontal balancing, can be easily formed at the same time as forming the heating body pattern.

Figure 17A:
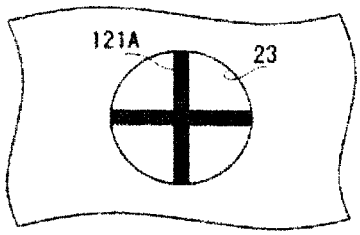
FIG. 17A is a diagram illustrating a state in which the lamination reference mark of FIG. 16A and a round-punched head positioning reference mark are aligned with each other in the direction along the one surface of the glass substrate.
Figure 17B:
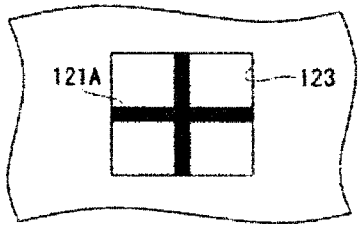
FIG. 17B is a diagram illustrating a state in which the lamination reference mark of FIG. 16A and a square-punched head positioning reference mark are aligned with each other in the direction along the one surface of the glass substrate.
Figure 18A:
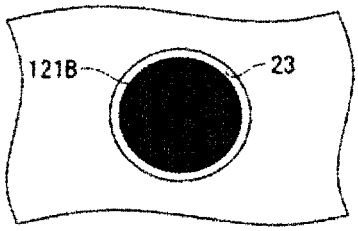
FIG. 18A is a diagram illustrating a state in which the lamination reference mark of FIG. 16B and a round-punched head positioning reference mark are aligned with each other in the direction along the one surface of the glass substrate.
Figure 18B:
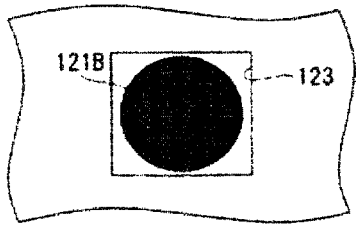
FIG. 18B is a diagram illustrating a state in which the lamination reference mark of FIG. 16B and a square-punched head positioning reference mark are aligned with each other in the direction along the one surface of the glass substrate.

In this case, when the lamination reference mark 121A of a cross shape is used, as illustrated in FIGS. 17A and 17B, it is easy to see a deviation amount within an adjustment range and a vertical and horizontal deviation amount can be instinctively recognized at once. Therefore, workability of positioning can be increased. Further, when the lamination reference mark 121B of a round shape is used, as illustrated in FIGS. 18A and 18B, it is possible to adjust the positions based on the relative size and positional relationships even if both the shape of the head positioning reference mark 23 or 123 and the shape of the lamination reference mark 121B are not formed as designed.

What is claimed is:

1. A head unit, comprising:

a thermal head, including a heating body formed on one surface of a glass substrate made of a transparent glass material, the heating body being configured to generate heat when supplied with external power; and a support body which is laminated onto the glass substrate in a stacked state, wherein the glass substrate and the support body each include a plurality of positioning marks which are disposed so as to be mutually aligned in a direction along the one surface of the glass substrate.

2. A head unit according to claim 1, wherein the glass substrate includes two thin substrates which are bonded to each other in a stacked state, and at least one of the two thin substrates has a concave portion opened in a bonding surface in a region opposed to the heating body.

3. A printer, comprising:

the head unit according to claim 1; and a roller for feeding a thermal recording medium while pressing the thermal recording medium against the heating body of the thermal head.

4. A head unit according to claim 1, wherein the thermal head includes a plurality of heating bodies arrayed on the one surface of the glass substrate.

5. A head unit according to claim 4, wherein the positioning marks of the support body comprise holes aligned with the positioning marks of the glass substrate.

6. A printer, comprising:

the head unit according to claim 4; and a roller for feeding a thermal recording medium while pressing the thermal recording medium against the heating body of the thermal head.

7. A method of manufacturing a head unit, comprising:

forming positioning marks on one surface of a glass substrate made of a transparent glass material;

forming positioning marks on one surface of a support body; and laminating the glass substrate and the support body to each other in a stacked state so that the positioning marks of the glass substrate and the positioning marks of the support body are mutually aligned in a direction along the one surface of the glass substrate.

8. A method of manufacturing a head unit according to claim 7, wherein the forming of the positioning marks of the glass substrate includes forming the positioning marks on the one surface of the glass substrate at the same time as forming a heating body, and wherein the forming of the positioning marks of the support body includes forming the positioning marks at the same time as processing an external shape of the support body.

9. A method of manufacturing a head unit according to claim 7, further comprising:

bonding two thin substrates to each other in a stacked state, at least one of which has a concave portion formed in a surface, so as to close an opening of the concave portion, to thereby form the glass substrate; and forming the heating body on the glass substrate in a region opposed to the concave portion formed in the at least one of the two thin substrates.

* * * * *